US010041026B2

(12) United States Patent
Arora et al.

(10) Patent No.: US 10,041,026 B2
(45) Date of Patent: Aug. 7, 2018

(54) WATER SOLUBLE LAUNDRY CAPSULE COMPRISING REDUCED LEVELS OF FINES IN HEDP

(71) Applicant: Conopco, Inc., Englewood Cliffs, NJ (US)

(72) Inventors: Rajat Arora, Heswall (GB); Mark John Henry, Coedpoeth (GB); Kerry Elizabeth Hodkinson, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 39 days.

(21) Appl. No.: 15/120,627

(22) PCT Filed: Feb. 17, 2015

(86) PCT No.: PCT/EP2015/053301
§ 371 (c)(1),
(2) Date: Aug. 22, 2016

(87) PCT Pub. No.: WO2015/128223
PCT Pub. Date: Sep. 3, 2015

(65) Prior Publication Data

US 2017/0067004 A1 Mar. 9, 2017

(30) Foreign Application Priority Data

Feb. 27, 2014 (EP) ..... 14157057

(51) Int. Cl.

| | |
|---|---|
| ***C11D 17/04*** | (2006.01) |
| ***C11D 17/06*** | (2006.01) |
| ***C11D 3/36*** | (2006.01) |
| ***C11D 3/37*** | (2006.01) |
| ***C11D 3/386*** | (2006.01) |
| ***C11D 11/00*** | (2006.01) |
| ***C11D 1/22*** | (2006.01) |
| ***C11D 1/66*** | (2006.01) |

(52) U.S. Cl.
CPC ..... *C11D 17/045* (2013.01); *C11D 1/22* (2013.01); *C11D 1/66* (2013.01); *C11D 3/361* (2013.01); *C11D 3/3753* (2013.01); *C11D 3/386* (2013.01); *C11D 11/0017* (2013.01); *C11D 17/06* (2013.01)

(58) Field of Classification Search
None
See application file for complete search history.

(56) References Cited

U.S. PATENT DOCUMENTS 3,527,795 A * 9/1970 Rose
6,815,410 B2 11/2004 Boutique
2003/0050210 A1* 3/2003 Pounds ..... B65D 81/3261 510/297
2003/0199414 A1* 10/2003 Boutique ..... C11D 3/2086 510/293
2004/0024245 A1 2/2004 Grawe et al.
2005/0245416 A1* 11/2005 Veening ..... C11D 11/0041 510/295
2009/0011971 A1* 1/2009 Evers ..... C11D 3/3942 510/296
2010/0113318 A1* 5/2010 Wiedemann ..... C11D 17/043 510/218
2010/0190677 A1* 7/2010 Esposito ..... C11D 3/3761 510/296
2010/0192986 A1* 8/2010 Brooker ..... B65D 65/46 134/29
2012/0159904 A1 6/2012 Catlin et al.

FOREIGN PATENT DOCUMENTS

| | | |
|---|---|---|
| EA | 1394065 | 3/2004 |
| EP | 0684303 | 11/1995 |
| EP | 1293557 | 7/2002 |
| EP | 1319707 | 11/2002 |
| EP | 1328616 | 7/2003 |
| EP | 1375637 | 1/2004 |
| GB | 2332442 A * | 6/1999 |
| WO | WO0183657 | 8/2001 |
| WO | WO0226751 | 4/2002 |
| WO | WO2010088112 | 8/2010 |

OTHER PUBLICATIONS

IPRP in PCTEP2015053301, dated Sep. 3, 2016.
Search Report & Written Opinion in EP14157057, dated Jul. 7, 2014.
Search Report & Writtent Opinion in PCTEP2015053301, dated May 15, 2015.

* cited by examiner

*Primary Examiner* — Lorna M Douyon
(74) *Attorney, Agent, or Firm* — Karen E. Klumas

(57) ABSTRACT

The present invention relates to a multi-compartment water soluble laundry detergent capsule formed from water-soluble polyvinyl alcohol film and a method of preparing a component of the capsule wherein the capsule comprises: i) a first compartment for holding solid material comprising HEDP sequestrant or a salt thereof; and ii) a second compartment for holding liquid material comprising an aqueous liquid laundry detergent comprising: surfactant, enzymes and hydrotrope wherein: a) the HEDP is present in the capsule in the form of loose packed granules and comprises at least 25% by weight of the solid material in the first compartment; and b) wherein the HEDP further comprises 1.5% by weight or less of fines particles with a particle of less than 180 microns and 3.0% by weight or less of fines particles with a particle size of less than 355 microns.

13 Claims, No Drawings

WATER SOLUBLE LAUNDRY CAPSULE COMPRISING REDUCED LEVELS OF FINES IN HEDP

TECHNICAL FIELD

This invention relates to multi-compartment water soluble capsules suitable for providing a unit dose of laundry detergent wherein one compartment of the capsule comprises HEDP (1-hydroxyethane 1,1-diphosphonic acid) with specific reduced levels of fines particles. More specifically the present invention relates to a multi-compartment water soluble laundry detergent capsule, wherein the capsule is formed from water-soluble polyvinyl alcohol film and wherein one compartment of the capsule comprises HEDP (1-hydroxyethane 1,1-diphosphonic acid) which has been sieved prior to inclusion in the capsule to remove specific fines fractions.

BACKGROUND

A specific material that detergent formulators wish to include in a laundry detergent liquid composition is HEDP (1-hydroxyethane 1,1-diphosphonic acid), preferably as a sodium salt, and sold under the trade name Dequest 2010 by Thermphos. HEDP is known in laundry formulations as a sequestrant/chelating agent to control $Ca^{2+}$, $Mg^{2+}$ levels and to sequestrate metal ions which helps to remove certain types of troublesome stains such as red wine, tea etc. If HEDP could be included at concentration of at least 2 weight %, a small dose of non-aqueous liquid delivered from a water soluble capsule would give significant benefits on such stains. However, this 2 weight % level far exceeds the solubility of HEDP in conventional non-aqueous liquid. Even if the levels of solvent in the liquid were increased, the inclusion of HEDP at the required effective level into such non-aqueous liquids remains a problem because it does not stay in solution over time. It is also undesirable to increase non-aqueous solvent or hydrotrope levels to solve the problem in this way.

A further problem facing laundry detergent manufactures, especially when powders are employed, is the deposition of un-dissolved residues formed from components of the detergent formulation remaining on the laundry when the wash is complete. This is a particular problem when washing dark laundry as residues remaining on the laundry wash appear as white powdery dustings, or even worse, as white jelly like deposits, which cannot simply be brushed away by the consumer. This is most undesirable for consumers and the environment as significant levels of 'fines' require the laundry to be re-washed, using additional water and power to complete the laundry task.

The term 'fines' refers to a granular fraction present in for example HEDP and which may arise from a breakdown of the compound during manufacture and processing.

Therefore, a problem remains for the detergent formulators of how to incorporate the desired level of HEDP in a laundry detergent formulation, in combination with other laundry components, without obtaining residual deposits on the washed laundry.

U.S. Pat. No. 6,815,410 (P&G) suggests to agglomerate the HEDP and suspend it in the liquid. Suspension requires some form of liquid structuring and the resulting liquid is cloudy. Consumers prefer clear liquids. Suspended materials also need to be well dispersed during manufacturing or else the concentration levels within the formulation vary undesirably from one capsule to another, with consequent variable performance and reduced stability. HEDP is also known to sometimes have adverse reactions with other laundry ingredients, especially certain enzymes, which are usually present in non-aqueous laundry liquids in capsules. In EP1319707 (Unilever) there is taught the phase separation of solid and liquid parts within a capsule. It has, however, been found that consumers do not appreciate such a phase separated approach. An alternative approach is described in EP1328616 (P&G) where selected insoluble benefit agents are suspended in the liquid inside the capsule by use of an additional external structuring system. Like solvents and hydrotropes, such a structuring system adds volume, cost and complexity to the capsule and some otherwise suitable structuring systems may provide further limitations on the types of ingredients that may be incorporated into the liquid. For example the hydrogenated castor oil taught in EP1328616 is incompatible with lipolytic enzyme inclusion.

Consequently, the problem of how to include a desired amount of HEDP in a laundry detergent formulation has been reconsidered. It is well known to use separate compartments within a capsule to segregate ingredients. Multi-compartment capsules having stacked, internally divided or side by side compartments have been described in the patent literature. Segregation by means of one compartment inside another compartment is known from EP1293557 (Unilever).

In addition, in WO2010/088112, a two-compartment "stacked" capsule is disclosed having a smaller liquid compartment and a larger powder compartment. The two compartments are separated by a layer of polyvinylalcohol film. This disclosure is mainly focused on dishwashing compositions. The exemplary two compartment capsule has a powder compartment mainly composed of percarbonate bleach granules. HEDP is included in the powder at a level of 1.5 weight % of the total composition. The liquid compartment has an undesirably high level of non-aqueous solvent level at over 60 weight % of the total composition and it contains no enzymes.

WO2001/083657 (P&G) discloses a multi-compartment pouch made from a water-soluble film and having at least two compartments, wherein a least one compartment comprises a solid component of a composition and at least one compartment comprises a liquid component of a composition. Materials normally supplied as granules and insoluble materials, for example surfactants, insoluble builders and enzymes are described as such solid components. Examples are given of laundry detergent compositions in a polyvinyl alcohol pouch. The materials disclosed in this patent document for inclusion in the "solid compartment" evolve gas on contact with water. It is believed that the gas evolved from such materials counters the ingress of water through a rupture hole in the capsule film and allows the film to continue to dissolve from the outside before the solid contents dissolve to form a strong enough electrolytic solution inside the capsule compartment to significantly inhibit further film dissolution. Inclusion of a non-gas generating material like HEDP into a solid compartment without a significant amount of gas evolving material also in the solid compartment poses problems. Furthermore, as HEDP has interactions with enzymes, this configuration of HEDP and enzymes in the same compartment is not desirable.

A multi-compartment capsule is also disclosed in EP 1375637 and EP 1394065 (Unilever). These publications disclose multi-compartment packages comprising between 2 to 5 compartments and obtained by thermoforming a water-soluble film. Each compartment of the package contains a different part of a cleaning composition and the compartments are connected to each other and separated from one another by at least one flat seal area. One compartment may contain a liquid part of the detergent composition and another compartment a granular part of the composition, for example: bleach or builder.

Incomplete dissolution of polyvinylalcohol capsules when placed in a wash cycle may also lead to some residue deposition formed from the capsule material. Furthermore, incomplete dissolution of the capsules may also lead to entrapment of powder components, and thereby exacerbate the problem of unsightly residues being deposited on the washed laundry.

None of the above prior art documents address the issue of residue deposition when using HEDP in a laundry formulation, and none of the prior art documents detail how such problems may be mitigated.

There therefore exists the need for a multi-compartment water soluble laundry detergent capsule which is able to deliver the required level of HEDP in a laundry formulation and which overcomes the problems of prior art capsules.

In addition, there exists the need for a multi-compartment water soluble laundry detergent capsule which is able to deliver the required level of HEDP in a laundry formulation and which provides acceptable wash capabilities, with greatly reduced or no deposition of component residue or capsule on the laundry.

Surprisingly, the inventors have now found that controlling the level of certain fractions of fine material, commonly referred to as 'fines', present in the HEDP has a profound effect on the deposition of residues arising from either the polyvinyl alcohol film or the components of the laundry composition.

SUMMARY OF THE INVENTION

Therefore according to the present invention there is provided:

- a multi-compartment water soluble laundry detergent capsule, wherein the capsule is formed from water-soluble polyvinyl alcohol film and wherein the capsule comprises:
  - i) a first compartment for holding solid material comprising HEDP sequestrant or a salt thereof; and
  - ii) a second compartment for holding liquid material comprising an aqueous liquid laundry detergent comprising: surfactant, enzymes and hydrotrope wherein:
    - a) the HEDP is present in the first compartment in the form of loose packed granules and comprises at least 25% by weight of the solid material in the first compartment; and
    - b) wherein the HEDP further comprises 1.5% by weight or less of fines particles with a particle of less than 180 microns and 3.0% by weight or less of fines particles with a particle size of less than 355 microns.

Also in relation to the present invention, in the capsule the HEDP may comprise 1.0% or less by weight of fines particles with a particle size distribution of less than 180 microns; more preferably 0.5% or less by weight of fines particles with a particle size distribution of less than 180 microns.

Furthermore, in the capsule according to the present invention the HEDP may comprise at least 30% by weight of the solid material in the first compartment, more preferably at least 40% by weight of the solid material in the first compartment.

In addition, in the capsule according to the present invention the HEDP may comprise 2.0% or less by weight of fines particles with a particle size distribution of less than 355 microns.

In the capsules of the present invention, the HEDP granules are preferably HEDP tetra sodium salt. However, it will be appreciated by the skilled reader that alternative suitable salts may be employed consistent with laundry applications.

It is also preferred that the mean particle size of the HEDP granules in the capsules is in the range 600 to 950 microns. More preferably, the mean particle size of the HEDP granules in the capsules is in the range 800 to 950 microns. Most preferably the mean particle size of the HEDP granules in the capsules is in the range 875 to 925 microns.

It is also preferred that in the capsule according to the present invention the first compartment comprises 2 g or less of HEDP and the second compartment comprises 20 to 45 g liquid. More preferably, the first compartment comprises 2 g or less of HEDP and the second compartment comprises 20 to 30 g of liquid. Most preferably, the first compartment comprises 2 g or less of HEDP and the second compartment comprises 18 to 23 g of liquid.

Furthermore, in the capsule of the present invention the film thickness of the first compartment is preferably 90 microns or less. More preferably, in the capsule of the present invention the film thickness of the first compartment is in the range 70 to 88 microns. Even more preferably in the capsule of the present invention the film thickness of the first compartment is in the range 72 to 85 microns. A film thickness of 75 to 82 microns is however most preferred for first compartment of the capsule of the present invention.

Whilst HEDP may comprise 30% by weight of the solid material in the first compartment, the first compartment may contain only HEDP as the solid material. Also in relation to the present invention at least 5% by volume of the first compartment may be totally free from the HEDP granules. More preferably, at least 10% by volume of the first compartment may be totally free from the HEDP granules.

According to a second aspect of the present invention there is provided a method of preparing a batch of HEDP granules for use in a capsule according to a first aspect of the present invention wherein the HEDP granules are sieved one or more times prior to inclusion in the capsule; and

- wherein once sieved the batch of HEDP granules comprise 1.5% by weight or less of fines particles with a particle of less than 180 microns and 3.0% by weight or less of fines particles with a particle size of less than 355 microns.

In the method of the present invention the HEDP granules may be sieved twice or more times prior to inclusion in the capsule; and

- wherein once sieved the batch of HEDP granules comprise 1.0% by weight or less of fines particles with a particle of less than 180 microns and 2.0% by weight or less of fines particles with a particle size of less than 355 microns.

Throughout this specification references to polyvinyl alcohol include polyvinyl alcohol derivatives and/or partially hydrolysed polyvinyl alcohol unless it is explicitly stated that they do not.

In relation to the capsules of the present invention, for HEDP granules it is possible to obtain the desired solubility of the HEDP provided that HEDP has been sieved to remove to a great extent fines in the HEDP with a particle size of less than 355 microns. In addition, it is preferred that at least the first compartment containing the granules has enough free space to ensure that the granules remain loose packed.

In one preferred embodiment the solid containing first compartment is relatively low in volume and the liquid compartment is relatively high in volume but still smaller than would be the case if extra solvent were added to incorporate the HEDP into the liquid. For example 2 g or less of HEDP is used with 20 to 45 g of liquid. If there is more than one solid containing compartment, only one may contain the HEDP, preferably in isolation. Likewise the liquid may be split between two or more compartments depending on the requirements of the formulation and the capsule design.

DETAILED DESCRIPTION OF THE INVENTION

Multi-Compartment Capsule

The multi-compartment capsule (the capsule) of the present invention comprises at least two distinct compartments. The capsule is preferably formed by a process known as thermoforming. In the process, a first sheet of polyvinylalcohol film is heated and drawn into a mould. During the drawing process the film is usually held in position by means of a vacuum applied through ducts. Normally, the film is held substantially still under elastic deformation and the heating and shape of the mould enable the film to be drawn into the mould without the film thinning at stress points. The composition to be contained within the capsule is then filled into recesses formed in the film temporarily as a result of the forming process. It is preferred that the compartments are not overfilled or fully filled. In the next stage, the filled recessed first sheet is held in place in the mould by means of vacuum, and a second sheet is laid over the top and sealed to the first sheet around the edges of the mould. Sealing of the polyvinylalcohol sheets may be achieved by for example by water sealing, heating or UV sealing, or some other means which ensures contiguous contact between the sheets. A preferred method of sealing the sheets however involves wetting the sheets with water. The two layers of secured polyvinylalcohol sheeting therefore form a web of sealed capsules. The web of sealed capsules so formed may then be cut into individual capsules, which may then be removed from the moulds. Consequently, once the vacuum is removed and the capsule is released from the mould the capsule equilibrates. That is, the second polyvinylalcohol sheet bulges out and the first sheet of film 'springs back' or resiliently deforms to a smaller deformation than it occupied in the mould.

The Capsule Film

The capsule film used in the present invention comprises polyvinyl alcohol or a polyvinyl alcohol derivative. The film may comprise further conventional film materials found in polyvinyl alcohol films including plasticisers, humectants, fillers, and solvents. Functional ingredients, such as UV absorbers may also be incorporated into the film. Other functional ingredients that may be incorporated in or on the surface of the film include but are not limited to: enzymes, salts to control film dissolution as described in EP1844091 and EP1848759, and powder materials, particularly talc to prevent wet tack as described in EP1498473. The outer surface of the capsule film may further comprise information or possess a pattern printed or otherwise applied to it on each side of the capsule; part of the capsule; or on all of the surface area of the capsule. The printing may be performed prior to formation of the capsule; during formation of the capsule; or after formation of the capsule.

Films may be obtained by: casting, blow-moulding, extrusion or blow extrusion of the polymer material as known in the art.

In addition, the solubility of the polyvinyl alcohol may be controlled by its degree of hydrolysis, molecular weight and other factors as is known in the art.

The capsule film may comprise one or more additional ingredients in combination with the polyvinyl alcohol polymer. For example, it may be beneficial to add to the capsule film: plasticisers, for example glycerol, ethylene glycol, diethylene glycol, propylene glycol, sorbitol and mixtures thereof, additional water, disintegrating aids. It may also be beneficial that the capsule film itself comprises a detergent additive to be delivered to the wash water, for example polymeric soil release agents, dispersants, dye transfer inhibitors.

The Liquid Component

The liquid compartment or compartments of the capsule comprise the majority of the surfactant cleaning system provided by the capsule. The liquid compartment or compartments may also comprise enzymes, and any necessary solvents and hydrotropes to maintain the stability and clarity of the liquid. Optionally, the liquid compartment further comprises: antifoam, colorant, fluorescer, perfume and dispersant. A preferred liquid component may be ethoxylated polyethylene imine (EPEI).

A preferred surfactant system comprises amine neutralised LAS acid (LAS being a C12-14 linear alkyl benzene sulphonate mixed with non-ionic surfactant. Preferably the neutralised LAS may be in slight excess of the non-ionic surfactant. A preferred non-ionic surfactant is a C12-14 alcohol ethoxylate, most preferably with an average degree of ethoxylation of about 7 to 9. The amine used to neutralise the LAS acid may be 2-amino ethanol.

A preferred antifoam agent is hardened fatty acid soap, for example hardened coconut fatty acid.

The liquid component may further comprise a soluble sequestrant to enhance stability: a suitable sequestrant for this purpose is Diethylenetriaminepenta(methylenephosphonic acid) sodium salt, sold as Dequest 2066 by Thermphos.

A preferred hydrotrope/solvent system is monopropylene glycol (MPG) and glycerol.

Preferred enzymes present in the liquid compartment of the capsule are: proteases, amylases and mannanases. Lipases may also be included in the liquid compartment of the capsule.

The Solid Compartment

In accordance with the present invention, the solid compartment of the capsule comprises the 1-hydroxyethane 1,1-diphosphonic acid (HEDP) granules in the form of a salt. Preferred is Dequest 2016DG from Thermphos. The solid compartment may also if desired contain a minor part of coloured speckle granules, for example blue carbonate speckle granules. The particle size distribution of any such additional granules is preferably similar to that of the HEDP granules. However, it is preferred in relation to the present invention that such non functional material is absent from the solid compartment of the capsule. Most preferably HEDP is the only solid material present in its compartment.

The 1-hydroxyethane 1,1-diphosphonic Acid (HEDP) Granules.

The maximum amount of HEDP in the solid compartment of the capsule is preferably 2 g. Also, the amount of HEDP in the solid compartment is preferably in the range of 2 and 10 weight % of the total composition of the capsule. Most preferably, amount of HEDP in the solid compartment is preferably in the range of 4 and 8 weight % of the total composition of the capsule. A preferred salt of HEDP is a sodium salt or a potassium salt. However, the sodium salt of HEDP is the most preferred.

The invention will now be further described with reference to the following non-limiting examples.

EXAMPLES

Example 1

Dequest 2016DG and Dequest 2016DG-UL were sourced from Thermphos. Dequest 2016 DG and DG-UL are both the tetrasodium salt of 1-hydroxyethane 1,1-diphosphonic acid and has the structure (I).

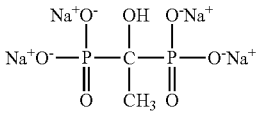

(I)

The term 'D' refers to a grade of material which is a spray dried powder. The term 'DG' refers to material which is compacted and broken into lumps whilst the DG/UL grade has been further processed with sieving.

The DG-UL grade has a particle size distribution with a lower level of fines compared to the D grade material. Even so, it was found that the HEDP in the form or DG-UL, contained too high a level of 'fines' with a particle size below 355 microns for use as a preferred sequestrant material in the capsule of present invention. More especially, it was found that the HEDP in the form of DG-UL, contained too high a level of 'fines' with a particle size below 180 microns for use as a preferred sequestrant material in the present invention. Accordingly the inventors further sieved the Dequest 2016 DG-UL material to achieve material with the required particle size distribution, especially the level of 'fines' with a particle size below 355 microns and below 180 microns.

More specifically, the HEDP, Dequest 2016 DG-UL was sieved using a 355 micron screen following a 410 micron screen. The further sieved Dequest 2016 DG-UL was then used directly to prepare laundry capsules, with the Dequest 2016 DG-UL incorporated into a single compartment of the laundry capsule. The properties of the sieved material versus the non-sieved material are detailed in Table 1.

TABLE 1

| Sample | Mean particle size X50 μm | **Percentage of particles with size less than 355 μm | Percentage of particles with size less than 180 μm | Dynamic flow rate ml/s |
|---|---|---|---|---|
| Dequest 2016 DG 25 kg sacks (non-sieved) | 655 | 24.26 | 11.02 | 94 |
| Dequest 2016 DG −UL, 25 kg sacks (non-sieved) ex Italmatch | 720 | 16.6 | 11.11 | 97 |
| Dequest 2016 DG −UL, 1 ton, Big Bag sieved once. | 860 | 3.96 | 2.14 | 138 |
| Dequest 2016 DG −UL, 1 ton, Big Bag sieved once, and then sieved for a second time. | 853 | 1.0 | 0.25 | 141 |

Dequest 2016-HEDP (1-hydroxyethane 1,1-diphosphonic acid sodium salt).

**In Table 1 the values provided for the percentage of particles with a particle size of less than 355 microns also include the amount of particles with a particle size of less than 180 microns.

From Table 1 is can be seen that fractions of the HEDP sequestrant with a particle size of less than 180 μm and less than 355 μm were compared.

The Dequest DG and DG-UL 25 kg sacks both contain more than 11% fines fractions with a particle size of less than 180 μm. It is understood that the increased levels of fines in the Dequest 2016 DG-UL material with a particle size of less than 180 μm may arise during packing the material into the 25 kg sacks.

In addition, the Dequest DG and DG-UL 25 kg sacks both contain more than 16% fines fractions with a particle size of less than 355 μm.

It can be seen from Table 1 that the further sieved HEDP material contains much lower percentages of the fines fraction with a particle size of less than 180 μm, and also with a particle size of less than 355 μm.

In relation to the present invention it has been found that it is preferred to use HEDP sequestrant with 1.5% or less of the fines fraction with a particle size of less than 180 μm. Even more preferably, HEDP is preferred for use in the present invention with 1.0% or less of the fines fraction with a particle size of less than 180 μm. Most preferably HEDP sequestrant should be used with 0.5% or less of the fraction with a particle size of less than 180 μm.

In addition, it is preferred that HEDP is used with 3.00% or less of the fraction with a particle size of less than 355 μm. Most preferably, HEDP is used with 2.00% or less of the fraction with a particle size of less than 355 μm.

It is therefore preferred that a sample of sieved HEDP sequestrant suitable for use in the present invention but not limited thereto may therefore possess the following particle size distribution.

TABLE 2

| Particle Size in microns | % of Fraction in Sample. |
|---|---|
| 2 | 0.04 |
| 125 | 0.05 |
| 180 | 0.04 |
| 250 | 0.90 |
| 355 | 15.09 |
| 500 | 24.97 |
| 710 | 38.01 |
| 1000 | 20.85 |
| 1400 | 0.03 |
| 2000 | 0.00 |

That is, fines with a particle size of less than 355 microns have been substantially removed from the HEDP sample. More specifically, fines with a particle size of less than 180 microns and less than 355 microns have been substantially removed from the HEDP sample prior to incorporation in a water soluble capsule.

Example 2

Laundry Test—Preparation of Capsules

Capsules comprising non-sieved and sieved HEDP in the form of DEQUEST 2016 DG-UL sequestrant, in a first compartment of the capsule were prepared and laundry tested to investigate the level of residues deposited on dark coloured cotton fabric as a result of the different levels of fines fractions in the HEDP.

The capsules tested had a second compartment containing 35 ml of a liquid composition A as given in Table 3, and a first smaller "solid" compartment comprising 2 g of sieved HEDP (that is, further sieved DEQUEST 2016 DG-UL). The first smaller solid compartment was less than 90% full by volume with sieved HEDP. The remainder of the first compartment was filled with air.

TABLE 3

| Liquid A | |
|---|---|
| LAS Acid (C12-14 linear alkyl benzene sulphonate) | 18.4 |
| Non-ionic surfactant (C12-14 alcohol ethoxylate) | 17.9 |
| Hardened coconut fatty acid | 15.3 |
| 2-amino ethanol (MEA) | 8.6 |
| EPEI (ethoxylated polyethylene imine) | 1.4 |
| Dequest 2066 (sequestrant) | 3.6 |
| Glycerin (glycerol) | 2.1 |
| MPG (Monopropylene glycol) | 17.9 |
| Water | 1.6 |
| Plus: | |
| Fluorescer | 0.15 |
| Protease | 0.8 |
| Perfume | 1.08 |
| Colour | 1.0 |
| Glycerin | 9.41 |
| Opacifier | 0.33 |
| Water | 0.33 |

The solid compartment in each case contained 2 g of HEDP.

Laundry Tests—Washing Machine Tests.

The capsules detailed in example 2 comprising the sieved and non-sieved HEDP samples from Table 1 were laundry tested and the laundry wash inspected for the presence of residues deposited on the fabric.

The laundry test employed is described as a 'Black Load Test', in which a mixed 3 Kg load consisting of 6 pieces of black coloured woven cotton material, 6 pieces of black coloured knitted cotton material and 6 pieces of black coloured polyester cotton material were washed in a Zanussi washing machine on a 30° C. wool wash cycle or a 30° C. quick wash cycle. The water used in the wash cycles was 26° F.H water and for each test a capsule was placed under the load before the wash cycle commenced. Once the wash cycle was complete, each of the eighteen pieces of black coloured material was studied for the presence of residues.

Residues present on the laundry were classified as follows:

Category F denotes the presence of a film residue on the laundry, which is only visible when the laundry is dry.

Category P denotes presence of severe powder residue present.

Category J denotes the presence of jelly on the laundry.

Category J/F denotes the presence of jelly and film on the laundry.

Category J/P denotes the presence of jelly and powder, formed as a result of the polyvinylalcohol film of the capsule trapping powder and being deposited on the laundry.

Category F/J/P denotes the presence of film, jelly and powder, formed as a result of the polyvinylalcohol film of the capsule trapping powder and being deposited on the laundry.

Table 4 details the results of the laundry tests and the various residue depositions for each of the capsules tested.

TABLE 4

| % of Fines in Capsule. | Results of residue inspection on black woven cotton, knitted cotton and polyester cotton material using 30° C. quick wash | Results of residue inspection on black woven cotton, knitted cotton and polyester cotton material using 30° C. wool wash |
|---|---|---|
| Dequest 2016 DG –UL, 1 ton, Big Bag sieved once, and then sieved for a second time, with 0.25 weight % particles with a particle size of less than 180 microns. | No residues visible on any of the black coloured woven cotton material, black coloured knitted cotton material or the black coloured polyester cotton material. | Very minimal J/F, J and F/J residues visible on black coloured woven cotton material, black coloured knitted cotton material or the black coloured polyester cotton material. |
| Dequest 2016 DG –UL, 1 ton, Big Bag sieved once, and then sieved for a second time, with 1.0 weight % particles with a particle size of less than 180 microns. | No residues visible on any of the black coloured woven cotton material, black coloured knitted cotton material or the black coloured polyester cotton material. | Very minimal P/F/J residues visible on black knitted cotton. |
| Dequest 2016 DG –UL, 1 ton, Big Bag sieved once, and then sieved for a second time, with 2 weight % particles with a particle size of less than 180 microns. | Evidence of J/F and F/J/P residues visible on black coloured woven cotton material and black coloured knitted cotton. | Evidence of extreme levels of J and F/J/P residues over a substantial amount of the woven cotton and evidence of F/J/P and J/F over much of the woven cotton and knitted cotton fabric. |
| Dequest 2016 DG –UL, 1 ton, Big Bag sieved once, and then sieved for a second time, with 3 weight % particles with a particle size of less than 180 microns. | Evidence of severe powder residues visible on black coloured woven cotton. | Evidence of extreme levels of F, F/J, F/P, F/J/P and J residues over a substantial amount of the woven cotton, knitted cotton and polyester cotton fabric. |
| Dequest 2016 DG –UL, 1 ton, Big Bag sieved once, and then sieved for a second time, with 5 weight % particles with a particle size of less than 180 microns. | Evidence of very severe F/J/P, F and J residues on Woven cotton. | Evidence of very extreme levels of F, F/J, J, J/F, F/J/P and J/P residues over a substantial amount of the woven cotton, knitted cotton and polyester cotton fabric. |
| Dequest 2016 DG –UL, 1 ton, Big Bag not sieved to remove fines with a particle size of less than 355 microns. | Evidence of very severe P/F and J residues on Woven cotton and knitted cotton. | Evidence of very severe P/F/J and F/J/P residues on the knitted cotton fabric and evidence of J, F, and F/J residues on the polyester cotton fabric. |

As can be seen from Table 4 the level of residues was found to be non-existent or much reduced when the HEDP in the capsules consisted of 0.25 weight % or 1.0 weight % of fines with a particle size of less than 180 microns. However, the level of residue deposits greatly increased as the weight % of fines with a particle size of less than 180 microns also increased.

Therefore, in summary, it appears that the inclusion of sieved HEDP in a capsule to limit the fines residues with a particle size of less than 180 microns and 355 microns does not have any negative effect on the detergent formulation and greatly reduces or mitigates the residue deposits of the fines material on fabric.

It has further been observed that fine particles of HEDP increase film residues especially under stressed low water wash conditions.

In the capsules of the present invention it has been observed that when the capsules are immersed in water, the part filled granule compartment ruptures and the film collapses against the granules due to the external water pressure. Then water seeps into the cavity compartment via the point of rupture and is absorbed into the loose mass of granules by capillary forces. The ingressing water being absorbed into the mass of the granules serves to slow down the rate at which a HEDP solution can build up in contact with the film sufficient to cause it to slow its dissolution to a point where residue problems are evident. During this delay phase the film continues to dissolve from the outside and eventually dissipates in small pieces which do not give rise to residue problems.

Whilst not wishing to be bound by any particular theory, it also appears form Table 4 that the levels of fines in the HEDP affects the ingressing water being absorbed into the mass of the granules, thereby affecting the rate at which a HEDP solution may build up in contact with the film sufficient to cause it to slow its dissolution to a point where residue problems are evident. Therefore, it is desirable to remove the fines residues with a particle size of less than 180 microns and 355 microns in the HEDP to greatly reduce or mitigate the residue deposits of fines material on fabric.

The invention claimed is:

1. A multi-compartment water soluble laundry detergent capsule, wherein the capsule is formed from water-soluble polyvinyl alcohol film and wherein the capsule comprises:

i) a first compartment for holding solid material comprising HEDP (1-hydroxyethane 1,1-diphosphonic acid) sequestrant or a salt thereof; and ii) a second compartment for holding liquid material comprising a liquid laundry detergent comprising: surfactant, enzymes and hydrotrope wherein:

a) the HEDP is present in the capsule in the form of loose packed granules and comprises at least 30% by weight of the solid material in the first compartment; and b) wherein the HEDP further comprises 1.5% by weight or less of fines particles with a particle size of less than 180 microns and 3.0% by weight or less of fines particles with a particle size of less than 355 microns.

2. The capsule according to claim 1 wherein the HEDP comprises 1.0% or less by weight of fines particles with a particle size of less than 180 microns.

3. The capsule according to claim 1 wherein the HEDP comprises 0.5% or less by weight of fines particles with a particles size of less than 180 microns.

4. The capsule according to claim 1 wherein the HEDP comprises at least 40% by weight of the solid material in the first compartment.

5. The capsule according to claim 1 wherein the HEDP comprises 2.0% or less by weight of fines particles with a particle size of less than 355 microns.

6. The capsule according to claim 1 in which the HEDP granules are HEDP tetra sodium salt.

7. The capsule according to claim 1 wherein the mean particle size of the HEDP granules is in the range 800 to 950 microns.

8. The capsule according to claim 1 in which the first compartment comprises 2 g or less of HEDP and the second compartment comprises 20 to 45 g liquid.

9. The capsule according to claim 1 in which the film thickness of the first compartment is 90 microns or less.

10. The capsule according to claim 1 wherein HEDP comprises 100% by weight of the solid material in the first compartment.

11. The capsule according to claim 1 wherein at least 10% by volume of the first compartment is free from HEDP granules.

12. A method of preparing a capsule as claimed in claim 1 in which comprises sieving the HEDP granules one or more times prior to inclusion in the capsule; and wherein the sieved HEDP granules includes in the capsule comprise 1.5% by weight or less of fines particles with a particle size of less than 180 microns and 3.0% by weight or less of fines particles with a particle size of less than 355 microns.

13. The method according to claim 12 wherein the HEDP granules are sieved twice or more times prior to inclusion in the capsule and wherein the sieved HEDP granules includes in the capsule comprise 1.0% by weight or less of fines particles with a particle size of less than 180 microns and 2.0% by weight or less of fines particles with a particle size of less than 355 microns.

* * * * *